US006488444B2

(12) United States Patent
Licata

(10) Patent No.: US 6,488,444 B2
(45) Date of Patent: Dec. 3, 2002

(54) MANHOLE PROTECTIVE PAD

(76) Inventor: Jack Joseph Licata, 25 Zabriski St., Hackensack, NJ (US) 07601

( * ) Notice: Subject to any disclaimer, the term of this patent is extended or adjusted under 35 U.S.C. 154(b) by 0 days.

(21) Appl. No.: 09/904,952

(22) Filed: Jul. 13, 2001

(65) Prior Publication Data

US 2002/0012570 A1 Jan. 31, 2002

Related U.S. Application Data

(63) Continuation of application No. 09/151,427, filed on Sep. 11, 1998, now abandoned.

(51) Int. Cl.[7] ..... E02B 13/00
(52) U.S. Cl. ..... 405/52; 52/20
(58) Field of Search ..... 428/131, 911, 428/405, 220, 219, 137; 442/79, 80, 85, 86, 91, 93, 121, 122, 395; 52/19, 20; 404/25; 454/48, 49; 405/38, 52

(56) References Cited

U.S. PATENT DOCUMENTS 3,901,993 A * 8/1975 Phillips, Jr. ..... 404/25 X
4,486,200 A * 12/1984 Heyer et al. ..... 51/295
5,308,188 A 5/1994 Shaftner
5,419,945 A * 5/1995 Lopez ..... 428/178
5,506,040 A * 4/1996 Cordani ..... 428/218
5,536,110 A 7/1996 Tompkins et al.
5,549,342 A 8/1996 Donaldson et al.
5,562,645 A * 10/1996 Tanzer et al. ..... 604/367
5,573,841 A * 11/1996 Adam et al. ..... 428/219
5,618,616 A * 4/1997 Hume et al. ..... 428/319.3
5,738,139 A * 4/1998 DeChard ..... 137/312
5,827,259 A * 10/1998 Laux et al. ..... 604/385.2
5,834,104 A * 11/1998 Cordani ..... 428/218
5,865,825 A * 2/1999 Schlinz ..... 604/385.2
6,143,394 A 11/2000 Patel et al. ..... 428/131

* cited by examiner

*Primary Examiner*—Christopher J. Novosad

(57) ABSTRACT

A protective mat for the pavement area surrounding an open manhole comprises a bottom layer of petroleum and contamination impervious preferably polyethylene sheet material laminated to an upper fibrous mat sheet layer preferably comprising cotton fibers bonded together to form a porous liquid absorbent layer.

13 Claims, 1 Drawing Sheet

FIG. 1
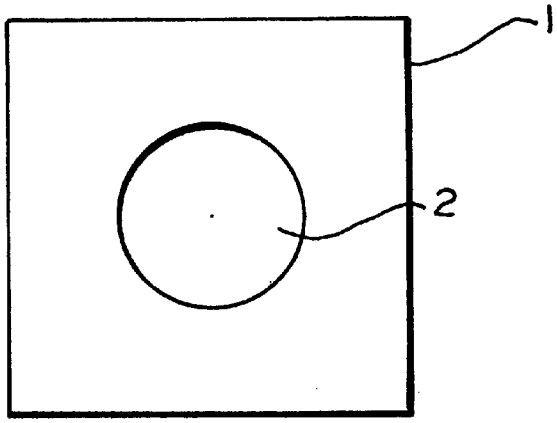
FIG. 2
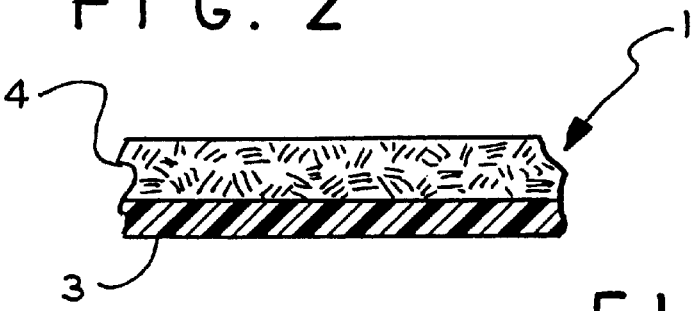
FIG. 3
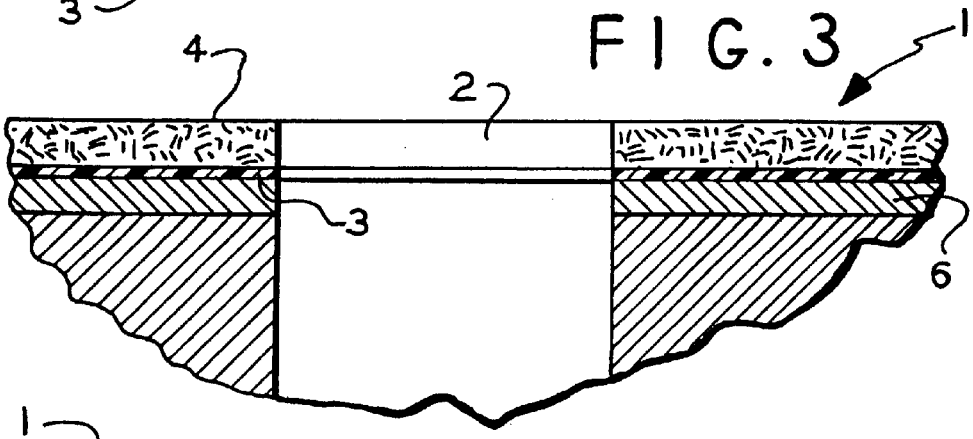
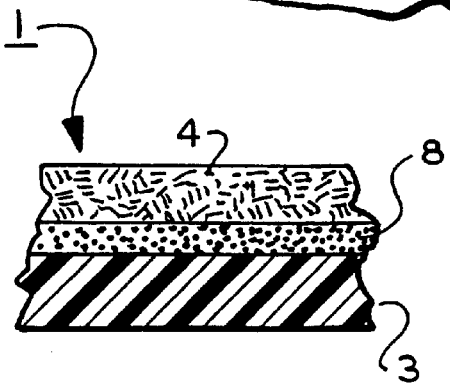
FIG. 4

MANHOLE PROTECTIVE PAD

This application is a continuation of application Ser. No. 09/151,427 filed Sep. 11, 1998, now abandoned.

This invention relates to protective pads for protection surrounding areas about a manhole from the spreading of contaminants from the footwear of workers using the manhole, spills from vacuum or flush trucks, pumps and so on.

Workers employed for work in manholes encounter liquids and contaminants which may include oil or petroleum products, soil and water or other contaminant materials. These contaminant materials adhere to the soles of the footwear of the workers. When the workers exit the manhole, the contaminants on their footwear tracks the region about the manhole onto surrounding pavement. Also, the contaminants are also tracked onto the foot pedals such as brake and accelerator pads of vehicles operated by the workers. The contamination is carried to such pads making them slippery and unsafe for operation. Also, the surrounding pavement area also tends to become slippery and unsafe as well as unsightly.

The present inventor recognizes a need for a protective apron for surrounding the manhole to preclude the spread of such contaminants.

A contaminant protective apron pad for use with a manhole in a pavement according to the present invention comprises a first layer for overlying said pavement and having a curved region for abutting said manhole; and a second layer secured to and overlying the first layer, the second layer comprising absorbent material for absorbing liquids and receiving and retaining contaminants contacting said second layer.

In one aspect, the first and second layers have an opening for overlying the manhole.

In a further aspect, the first layer is a thermoplastic material. In a still further aspect, the second layer is bonded to the first layer. In a further aspect, the second layer comprises cotton fibers. The second later may comprise a bonding matrix for securing the fibers into a porous mat.

The second layer in a still further aspect comprises cellulose fibers bonded to form a porous mat. Preferably the first layer comprises material resistant to petroleum and water. The second layer comprises material that has a surface that preferably is relatively slip resistant as compared to the second layer.

In a still further aspect, a method of protecting the surrounding pavement region of a manhole from contamination comprises placing a contaminant absorbent layer on the pavement adjacent to the manhole.

IN THE DRAWING

FIG. 1 is a plan view of a pad according to an embodiment of the present invention;

FIG. 2 is a side elevation fragmented sectional view of the pad of FIG. 1;

FIG. 3 is a side elevation fragmented sectional view of a manhole in a pavement with the pad of FIG. 1 in place; and FIG. 4 is a more detailed side elevation fragmented sectional view of the pad of FIG. 2.

In FIG. 1, pad 1 is shown as a square but could be other shapes, e.g., rectangular or circular for example. The pad 1 has a central opening 2. The pad 1, FIG. 2, comprises a bottom layer 3 and a top layer 4. The bottom layer 3 preferably is a sheet of polyethylene. The top layer 4 preferably is a mat of bonded fibers bonded to the sheet of polyethylene with a suitable oil, petroleum impervious adhesive 8, FIG. 4. In the alternative the sheet of Polyethylene may be softened sufficiently so that the top layer 4 bonds thereto upon cooling of the bottom layer 3.

The mat top layer 4 preferably comprises cotton fibers such as denim or other relatively strong fibers. Cotton is preferred because of its absorbance of liquids. Also, the mat as formed is porous for absorption of liquids and contaminants comprising solid particles and so on.

The pad may comprise commercially available laminated material available from KG Fibers of Palmyra, N.J. This is available as a flame retardant nonwoven roll. This material does not produce hazardous compositions products and does not exhibit polymerization. The product contains cotton threads generally produced as waste from other processes, latex and polyethylene employed as a backing layer.

The cotton mat material forming the top layer 4 exhibits relative high friction as compared to the polyethylene backing layer 3. This permits persons to walk thereon with contaminated soles on their footwear with relative safety.

The top layer 4 may be any desired thickness according to a given implementation. This material is fire retardant and absorbs approximately seven to eight times its volume in liquids.

The bottom backing layer is impervious to petroleum products and other contaminants such as oils, PCB's, greases, fats and water to preclude leaching therethrough from the top layer. This provides long life as the top layer absorbs such materials. The entire pad 1 is disposable once its maximum absorption has been reached. The pad 1 is preferably about 80 inches square, with a central opening 2 of about 36 inches diameter and is sufficiently flexible for formation into a roll for portability. When rolled after use, the contaminants are contained within the roll for safe transport for further use of the pad 1 or for disposal of the pad.

In FIG. 3, a manhole 5 is in pavement 6. The pad 1 overlies the manhole so that hole 2 provides access to the manhole 5. The pad 1 surrounds the manhole 5 with the bottom layer 3 overlying the pavement 6.

In use workers exiting the manhole 5 walk on the pad 1. The soles of their footwear carries liquid and solid contaminants from the interior of the manhole. These liquids and solid contaminants are deposited onto the pad 1 upper layer 4, which absorbs the liquids and retains the solid particles. This prevents the contamination from tracking onto the pavement 6 surface precluding slippery conditions from occurring as a result. Also, the contaminants are removed from the worker's footwear soles minimizing slippery conditions for the worker on the pavement. This removal of contaminants minimizes carrying the contaminants to automotive brake and accelerator pedals as well as the interior floor surfaces. This minimizes further tracking of contaminants to other areas.

The pad 1 thus provides a nonskid surface for workers, especially useful in inclement weather conditions which tend to introduce further slippery conditions which are unsafe in a region next to an open manhole.

It will occur that various modifications may be made to the illustrated embodiments without departure from the scope of the invention as defined in the appended claims. While cotton fibers for the mat are preferred other absorbent fibers may be used in the alternative. While a central opening is in the pad it will occur that a partial pad may be employed wherein the pad has a curved edge for abutting the manhole. The curved edge has a curvature that matches the curvature of the manhole opening, for example.

What is claimed is:

1. A contaminant protective apron pad for use with a manhole in a pavement comprising:

a first bottom layer for overlying and contacting said pavement and having an open central region for overlying said manhole so that the bottom layer extends about the manhole; and a second top layer secured to and overlying the first bottom layer and extending about the manhole, the second top layer comprising absorbent material for absorbing liquids and for receiving and retaining contaminants contacting said second top layer.

2. The contaminant protective apron pad of claim 1 wherein the first bottom layer is a thermoplastic material.

3. The contaminant protective apron pad of claim 2 wherein the second top layer is bonded to the first bottom layer.

4. The contaminant protective apron pad of claim 1 wherein the second top layer comprises cotton fibers.

5. The contaminant protective apron pad of claim 4 wherein the second top layer comprises a bonding matrix for securing the fibers into a porous mat.

6. The contaminant protective apron pad of claim 1 wherein the second top layer comprises cellulose fibers bonded to form a porous mat.

7. The contaminant protective apron pad of claim 1 wherein the first bottom layer comprises material resistant to petroleum and water.

8. The contaminant protective apron pad of claim 1 wherein the second top layer comprises material that has a surface that is relatively slip resistant as compared to the first layer.

9. The contaminant protective apron pad of claim 1 wherein the first bottom layer is polyethylene.

10. The contaminant protective apron pad of claim 1 wherein the second top layer is denim cotton fibers.

11. The contaminant protective apron pad of claim 1 wherein the first bottom layer and second top layer are each sheets of material.

12. A method of protecting the surrounding pavement region of a manhole from contamination comprising placing a contaminant absorbent layer on the pavement region and surrounding the manhole with the layer.

13. The method of claim 12 including first forming the layer of a bottom layer of contaminant impervious material and forming a top layer of absorbent fibers bonded to the bottom layer and then performing the placing step.

* * * * *